United States Patent [19]

Hanks et al.

[11] Patent Number: 4,457,445

[45] Date of Patent: Jul. 3, 1984

[54] VALVE CAP TAMPER-PROOF COVER

[75] Inventors: Robert S. Hanks, Thrussington; Philip H. Brodrick, Long Whatton, both of England

[73] Assignee: P.M. Plasmatic (Leicester) Limited, Leicester, England

[21] Appl. No.: 517,752

[22] Filed: Jul. 27, 1983

[30] Foreign Application Priority Data

Aug. 7, 1982 [GB] United Kingdom ..... 8222827

[51] Int. Cl.[3] ..... B65D 53/00; B65D 55/02

[52] U.S. Cl. ..... 220/214; 220/85 P; 220/319; 220/306; 220/270; 222/182; 222/153

[58] Field of Search ..... 220/214, 319, 85 P, 220/257, 259, 270, 306, 336; 215/274; 222/153, 182

[56] References Cited

U.S. PATENT DOCUMENTS

| | | | |
|---|---|---|---|
| 3,480,184 | 11/1969 | Handis | 222/182 |
| 4,176,756 | 12/1979 | Gellman | 220/319 |
| 4,353,483 | 10/1982 | Pehr | 220/85 P |
| 4,377,245 | 3/1983 | Patty | 220/319 |

*Primary Examiner*—George T. Hall

*Attorney, Agent, or Firm*—Charles A. Brown

[57] ABSTRACT

The invention relates to a pilfer-proof cap, for example for a beer container, which comprises two shell portions (4,6) connected by a hinge (8) incorporating a tear-strip, and capable of being secured around the valve of the container by a non-releasable fastening means (14,16). When authorized opening of the container is required, the tab (12) of the tear-strip is pulled away from the cap and releases the valve for use.

5 Claims, 7 Drawing Figures

VALVE CAP TAMPER-PROOF COVER

The invention is concerned with improvements in or relating to valve cap devices, particularly cap devices of the kind commonly referred to as pilfer-proof.

The purpose of cap devices of this kind is to indicate whether or not unauthorised operation of the valve may have taken place. An example of use of such a cap device is on a container containing, say, beer under pressure, where unauthorised tapping of the contents before use by the purchaser not only results in a reduction in the contents of the container, but also in the remainder of the contents being spoint through ingress of air. Use of a pilfer-proof valve cap device therefore makes it possible to check visually whether a container is full and unused.

The invention provides a valve cap device adapted to cover at least a portion of a fluid flow control valve to prevent unauthorized operation thereof, comprising a shell member adapted to conform at least approximately to the contours of the valve portion to be covered, said shell member having a parting line extending transversely thereof to form two shell portions, said shell portions being linked to each other adjacent a first end of said parting line by an integrally formed hinge portion, wherein said shell member is provided with a co-operating non-releasable fastening means adjacent a second end of said parting line and arranged to hold the two shell portions together in use to form the shell member, and wherein the hinge portion comprises a tear-strip.

In an example of the invention, one shell portion is provided with an end wall portion extending beyond said parting line so that when the two portions are fastened together, there is an overlap to hinder the insertion of a tool between the two shell portions. Where this overlapping portion is visible on the outside of the shell member, it may, if desired, carry advertising information either directly printed or as an adhesive label.

There will now be described an example of a valve cap according to the invention. It will be understood that the description, which is intended to be read with reference to the drawings, is given by way of example only and not by way of limitation.

Figure 1:
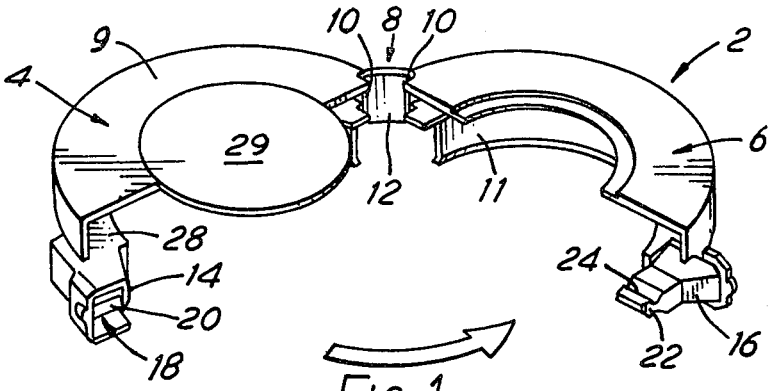
FIG. 1 is a perspective view of a valve cap device in which shell portions are in an open condition.
Figure 2:
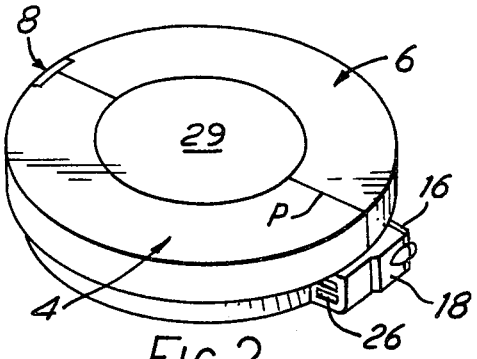
FIG. 2 shows the shell portions of FIG. 1 in a closed condition.
Figure 4:
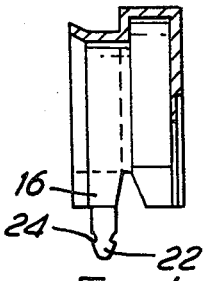
FIG. 4 is a section on line IV—IV of FIG. 3.
Figure 3:
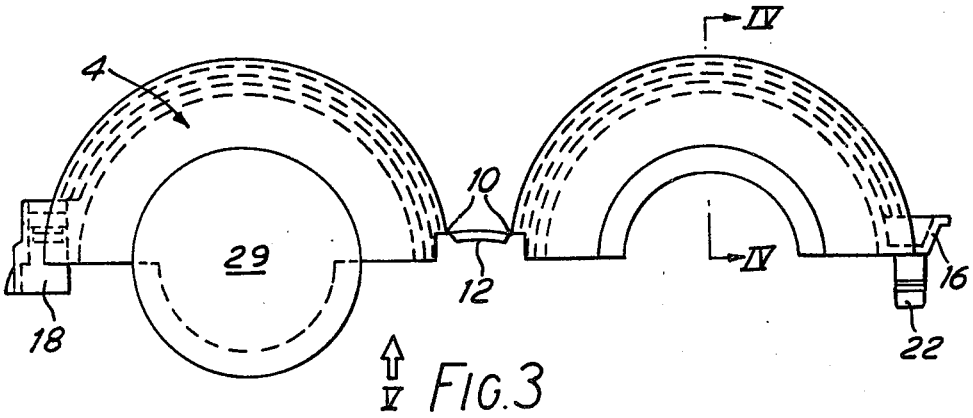
FIG. 3 is a plan view of the shell portions in an as-moulded position.

The valve cap device comprises a shell member 2 composed from two shell portions 4, 6, linked by a hinge portion 8. The shell member comprises an end wall 9 and a depending skirt portion 11. The hinge portion is formed by the provision of two parallel linear regions of reduced shell thickness, 10, axially formed in the skirt portion, the area between the regions 10 forming a removable tab 12, the purpose of which will be described below. Operation of the hinge portion 8 to close the shell portions 4, 6 into the position shown in FIG. 2 brings into engaging co-operation two fastening means 14, 16 provided at positions diametrically opposite the hinge portion.

Figure 5:
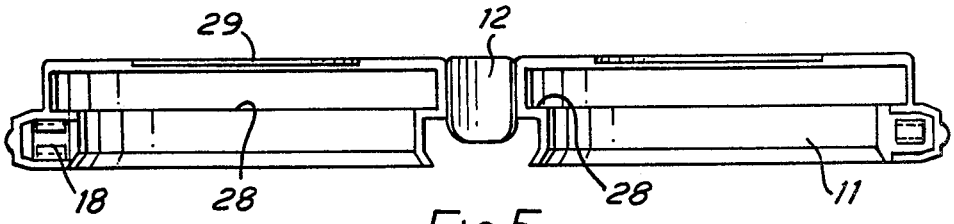
FIG. 5 is a view on arrow V of FIG. 3.
Figure 6:
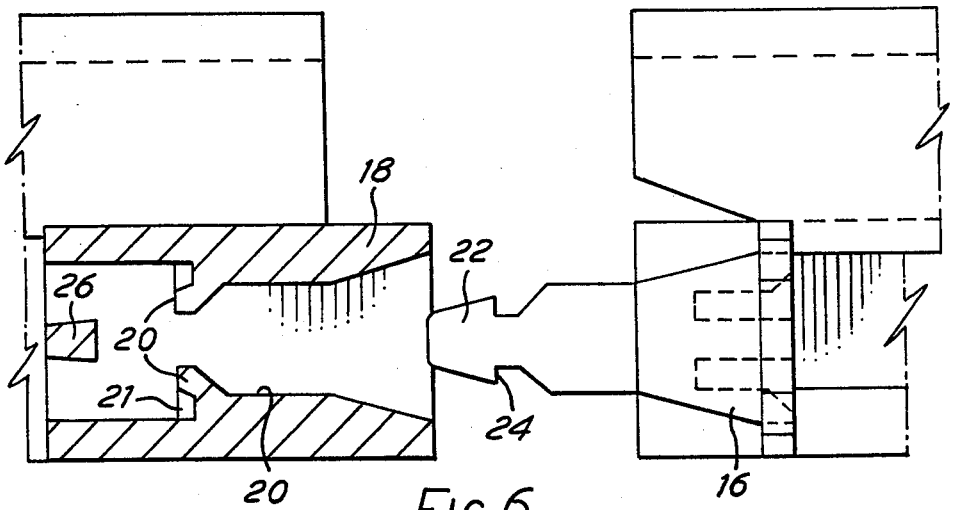
FIG. 6 is a part-sectional view of the fastening means of the shell portions to an enlarged scale.

The fastening means 14 is provided on shell portion 4 and comprises a recess 18 (FIGS. 5 and 6) having two stiffly flexible protuberances 20 set at an oblique angle to the wall of the recess, as best seen in FIG. 6. These protuberances may be reinforced if necessary by a buttress member 21.

The fastening means 16 is provided on shell portion 6 and comprises a projection 22 adapted to be received in the recess 18. Shoulder portions 24 provided on the projection 22 engage with the protuberances 20 of the recess 18 and the projection 22 is therefore non-releasable from the recess. Attempts to push the projection out of the recess may be deterred by the presence of a bar 26 of plastics material. In the present example, provision of an annular shoulder 28 on the inner surface of the skirt portion 11 enable a flange of the valve (not shown) to be rendered captive in said groove.

When the fastening means 14, 6 are interlocked the two shell portions co-operate along a parting line P to form a continuous shell around the valve to be protected. An extension 29 of the end wall portion of shell portion 4 is provided which overlaps the end wall portion of the shell portion 6 and is suitable to receive an informative adhesive label if desired. The overlap of the extension helps to deter the unauthorised insertion of a tool between the two shell portions.

Figure 7:
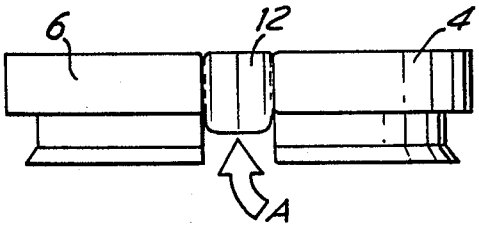
FIG. 7 is a view of the hinge portion of the device in a closed condition.

When the proper access is required to the contents of the container the valve of which is protected by the use of the present invention, the user will grasp the shell tab 12 at arrow A (FIG. 7) and pull it away from the shell member. The plastics material will tear along the linear regions 10 and the tab 12 will be completely removable. The shell portions 4, 6 may then be pulled apart into an open position to free the valve cap device from the valve.

We claim:

1. A valve cap device covering in use at least a portion of a fluid flow control valve to prevent unauthorised operation thereof, comprising a shell member adapted to conform at least approximately to the contours of the valve portion to be covered, said shell member having a parting line having a first end and a second end, said parting line extending transversely of the shell member to form two shell portions, said shell portions being linked to each other adjacent said first end of said parting line by an integrally formed hinge portion, wherein said shell member is provided with a co-operating non-releasable fastening means adjacent said second end of said parting line and arranged to hold the two shell portions together in use to form the shell member, and wherein the hinge portion comprises a tear-strip.

2. A device as claimed in claim 1, wherein the shell member comprises an end wall and a depending skirt portion, the tear-strip being formed by a tab defined by two parallel linear regions of reduced shell thickness in the skirt portion.

3. A device as claimed in claim 1, wherein the shell member comprises an end wall and a depending skirt portion, the tear-strip being formed by a tab defined by two parallel linear regions of reduced shell thickness in the skirt portion, said linear regions lying axially of the skirt portion.

4. A device as claimed in claim 2 wherein each shell portion includes an end wall portion which together form said end wall, there being provided upon one end wall portion an extension arranged in use to overlap the other end wall portion.

5. A device as claimed in claim 1 wherein the non-releasable fastening means comprises a projection formed on one shell portion receivable in a recess of the other shell portion, said projection having shoulder portions engageable with protuberances formed within the recess.

* * * * *